US009512591B2

(12) United States Patent
Spreitzer et al.

(10) Patent No.: US 9,512,591 B2
(45) Date of Patent: Dec. 6, 2016

(54) CLEANING DEVICE FOR CLEANING A BOTTOM OF A BOREHOLE AND METHOD FOR CREATING A FOUNDATION ELEMENT

(71) Applicant: BAUER Spezialtiefbau GmbH, Schrobenhausen (DE)

(72) Inventors: Stefan Spreitzer, Aresing (DE); Ulli Wiedenmann, Schrobenhausen (DE); Helmut Hross, Newe Territories (HK)

(73) Assignee: BAUER Spezialtiefbau GmbH, Schrobenhausen (DE)

( * ) Notice: Subject to any disclaimer, the term of this patent is extended or adjusted under 35 U.S.C. 154(b) by 0 days.

(21) Appl. No.: 14/858,498

(22) Filed: Sep. 18, 2015

(65) Prior Publication Data

US 2016/0083927 A1 Mar. 24, 2016

(30) Foreign Application Priority Data

Sep. 19, 2014 (EP) ..... 14185530

(51) Int. Cl.

| | |
|---|---|
| ***E02D 7/24*** | (2006.01) |
| ***E02D 13/08*** | (2006.01) |
| ***B08B 3/02*** | (2006.01) |
| ***E02D 5/34*** | (2006.01) |
| ***E21B 21/00*** | (2006.01) |
| ***E02D 5/46*** | (2006.01) |

(52) U.S. Cl.

CPC ..... *E02D 13/08* (2013.01); *B08B 3/02* (2013.01); *E02D 5/34* (2013.01); *E02D 5/46* (2013.01); *E21B 21/00* (2013.01)

(58) Field of Classification Search

USPC ..... 405/236, 240, 248, 224.1, 226; 299/17; 175/67, 424

See application file for complete search history.

(56) References Cited

U.S. PATENT DOCUMENTS

| | | | | |
|---|---|---|---|---|
| 1,428,788 A * | 9/1922 | Larsen | E02D 7/24 175/213 |
| 1,853,379 A * | 4/1932 | Rotinoff | E02D 5/32 175/205 |
| 3,965,687 A * | 6/1976 | Shaw | E02D 7/24 37/318 |

(Continued)

FOREIGN PATENT DOCUMENTS

| | | |
|---|---|---|
| DE | 2807917 A1 | 9/1978 |
| EP | 1491716 A2 | 12/2004 |

(Continued)

OTHER PUBLICATIONS

European Search Report, EP 14 18 5530, Mar. 13, 2015.

*Primary Examiner* — Sunil Singh

(74) *Attorney, Agent, or Firm* — Studebaker & Brackett PC

(57) ABSTRACT

The invention relates to a cleaning device for cleaning a bottom of a borehole in the ground and also to a method for creating a bored pile in a borehole. The cleaning device has a pumping means, through which sedimented ground material in the region of the bottom of the borehole can be sucked away via a suction opening and can be discharged from the borehole via a suction line. At least one flushing nozzle is provided, through which a flushing jet can be produced, which exits the cleaning device and flushes sedimented ground material from the bottom of the borehole. A bored pile can then be produced in a thus cleaned borehole.

11 Claims, 2 Drawing Sheets

(56) References Cited

U.S. PATENT DOCUMENTS 5,033,545 A 7/1991 Sudol

FOREIGN PATENT DOCUMENTS

| | | | |
|---|---|---|---|
| EP | 2481490 | A1 | 8/2012 |
| JP | S61-158517 | A | 7/1986 |
| JP | S61-196019 | A | 8/1986 |
| JP | H02-074720 | A | 3/1990 |

* cited by examiner

CLEANING DEVICE FOR CLEANING A BOTTOM OF A BOREHOLE AND METHOD FOR CREATING A FOUNDATION ELEMENT

TECHNICAL FIELD OF THE INVENTION

The invention relates to a cleaning device for cleaning a bottom of a borehole in the ground, with a pumping means, through which sedimented ground material in the region of the bottom of the borehole can be sucked away via a suction opening and be discharged from the borehole via a suction line according to the present invention.

The invention further relates to a method for creating a foundation element, wherein a borehole is created in the ground, the borehole is filled with a hardenable suspension which is hardened to form the foundation element, wherein before hardening of the foundation element a cleaning device is lowered to the bottom of the borehole, through which sedimented ground material in the region of the bottom is sucked away via a suction opening and removed, according to the present invention.

BACKGROUND OF THE INVENTION

In particular for the foundations of structural works, bored piles are produced in the ground. Initially a borehole is created in the ground which is filled with a suspension already during drilling or only after completion of the drilling works. This suspension can optionally be hardened by adding binding agents or exchanged for a hardenable medium in the borehole to form the bored pile.

The load bearing capacity of a bored pile is significantly influenced by the boundary layer between the bored pile and the adjacent ground. It is known that loose ground material which sediments or settles at the bottom of the borehole during creation of the borehole has a negative influence on the contact area and thus the load bearing capacity of the bored pile.

To remove such loose ground material from the borehole bottom it is known to lower an immersion pump as a cleaning device into the bore filled with suspension after completion of the drilling, with which immersion pump the loose ground material is sucked away from the bottom and removed from the borehole via a suction line.

In the case of such a cleaning device it can arise that loose ground material remains on the borehole bottom with increasing distance from the suction opening. Comprehensive cleaning of the borehole bottom is not therefore brought about with such a cleaning device.

It is further known to convey loose ground material away from the borehole mechanically for example by a drill bucket. However, a certain amount of loose ground material can remain at the bottom of the borehole with this mechanical excavation process.

EP 1 491 716 A2 discloses a drilling tool with a pumping means, with which removed ground material can be conveyed into a collecting container of the drilling tool.

A device and a method for filtering suspensions in boreholes follow from DE 28 07 917 A1. Filtered ground material is received in a collecting container within the filter device.

SUMMARY OF THE INVENTION

It is the object of the invention to indicate a cleaning device for cleaning a bottom of a borehole and also a method for creating a bored pile, with which loose ground material can be removed from a borehole bottom particularly reliably and efficiently and a high-quality foundation element can thus be economically created.

The object is achieved on the one hand by a cleaning device having the features discussed below. On the other hand the object is achieved by a method having the features discussed below. Preferred embodiments of the invention are indicated in the dependent claims.

The cleaning device according to the invention is characterised in that at least one flushing nozzle is provided, through which a flushing jet can be produced, the flushing nozzle exiting the cleaning device and flushing sedimented ground material from the bottom of the borehole.

A core idea of the invention lies in the fact that sedimented ground material at the borehole bottom is not simply sucked away or mechanically carried away. Instead, a flushing jet or a plurality of flushing jets is/are produced by the cleaning device which flush away the sedimented ground material from the borehole bottom and swirl it up. The ground material swirled up into the liquid in the borehole can be sucked more easily through the suction opening of the cleaning device and conveyed out of the borehole. Through this flushing of the borehole bottom a very clean separating surface can be achieved between the borehole and the solid, adjacent ground. Subsequently, a foundation element with a defined contact area and also with good and reliable load bearing capacity can hereby be created.

The foundation element can for example be a cylindrical bored pile or a cuboid-shaped slotted wall segment. Correspondingly, according to the invention a borehole is not to be understood narrowly in the sense of a cylindrical bore. Instead the term "borehole" also includes other shapes of holes in the ground, in particular an elongated milling slot.

In principle one or more central flushing nozzles can be provided on the cleaning device. A particularly good flushing is achieved according to a further development of the invention in that at least one flushing arm is provided, on which the at least one flushing nozzle is arranged. The elongated flushing arm can thereby extend laterally or radially away from the cleaning device. In this way the flushing arm can flush in particular the corner region, at which the borehole bottom crosses over into the substantially vertical borehole wall, free from deposited ground material particularly reliably. These corner regions are of particular significance for the stability and load bearing capacity of a bored pile to be formed.

A further improvement in the flushing follows according to a variant of the invention in that a plurality of flushing arms are provided which extend radially relative to a middle axis. One or more flushing nozzles can be aligned or arranged with different jet angles along a flushing arm.

A further improvement in the borehole bottom cleaning follows according to an embodiment according to the invention in that the at least one flushing arm is arranged on a rotor which is mounted to be rotatable about a middle axis and driven. The one or more flushing arms on the rotor can thus move over a disc-shaped borehole bottom and flush away deposited loose ground material with particularly high reliability.

According to a further preferred embodiment it is provided that at least one flushing nozzle is arranged on at least one rolling body which is mounted to be rotatable about a rotation axis. The rotation axis can preferably be arranged approximately horizontally. Boreholes with elongated or cornered contours can thus be cleaned. Instead of an elongated rolling body, a plurality of disc-shaped rolling bodies can also be arranged along the rotation axis. The flushing nozzles can thereby be orientated so that the flushing jets exit radially or tangentially.

In principle it is thereby possible that the rotation movement of the rotor or the rolling body is produced by a separate rotating motor, for example an electric motor or a hydraulic motor. A solution that is particularly robust in structural terms and simple is achieved according to a development of the invention in that a rotation movement of the rotor or the rolling body is produced by a flushing jet. In the case of a vertical rotation axis at least one flushing jet is not only vertically orientated, but instead in a circumferential direction. In particular a flushing jet or a plurality of flushing jets can be arranged in the horizontal direction in the circumferential direction, thus approximately at a right angle to a radial flushing arm. Due to the blowback principle the rotor or the rolling body can thus be set in rotation by the exiting flushing jet. A separate rotating motor with a corresponding energy supply is not therefore necessary.

The pumping means or a separate pump unit is preferably also used to produce the flushing jet. According to a preferred embodiment of the invention, in particular the pumping means sucks sedimented ground material together with liquid in the borehole, wherein a proportion of the sucked or drawn off liquid is carried away via a branch line to the at least one flushing nozzle to form the flushing jet. The pumping means in the cleaning device thus produces not only a suction flow, with which deposited ground material is sucked together with liquid and removed from the borehole via a corresponding suction line. Instead according to this embodiment of the invention the central pumping means is also used to produce the flushing jet or jets. For this, a portion of the upwardly orientated liquid flow is branched off from the suction line via a branch line or a bypass line and fed back to the at least one flushing nozzle. The control can be realised by a slider, through which a distribution of the liquid flow can be adjusted. In the area of the branch-off, a separating or filter means can thereby be provided, through which coarse ground material is prevented from getting into the branch line and blocking the flushing nozzles.

According to a further embodiment of the invention it is advantageous that a spacer ring is provided which surrounds the rotor or the rolling body. The cleaning device is thereby arranged centrally in the borehole above the bottom. In the case of a rotor this is mounted to be rotatable on the cleaning device about a middle axis. In order to avoid damage to the rotor with the flushing nozzles through contact with the borehole wall, a drum-shaped spacer ring is provided which is fixed by connecting struts to the housing of the cleaning device. The spacer ring has a larger diameter than the rotor and is arranged concentrically therewith. In this way undesired collisions of the rotor with the ground material can be prevented. In the case of other borehole shapes the spacer ring can also be designed with corners.

According to an embodiment of the invention it is further useful that the pumping means is arranged in a housing which can be lowered to the bottom of the borehole. A connecting means for fixing to a drill rod or a lifting cable is provided on the housing. The housing can hereby be lowered to the bottom of the borehole. Alternatively the pumping means of the cleaning device can also be arranged outside of the borehole, wherein the pumping means is then connected to the housing and the suction opening via a suction line.

It is further advantageous according to the invention that the at least one flushing nozzle and/or the at least one flushing arm is/are adjustable. The flushing nozzles can thus be changed in their flushing direction. The flushing arms can be radially telescopic so that the cleaning device can be adapted to different borehole diameters.

The aforementioned object is achieved with respect to the method in that a cleaning device is used with at least one flushing nozzle, through which a flushing jet is produced, through which sedimented ground material is flushed from the bottom of the borehole.

To carry out this method, in particular a cleaning device as previously described can be used. With the method according to the invention, due to the reliable cleaning of the borehole bottom with respect to sedimented loose ground material, a foundation element with particularly good load bearing capacity can be created. Since, in the case of a bored pile, the contact area contributes quite significantly to the load bearing capacity of the bored pile, bored piles with increased load bearing capacity can be created by the method according to the invention without excessive economic effort.

According to a preferred embodiment of the invention the at least one flushing nozzle is moved over the bottom of the borehole, in particular being driven in rotation. In this way, reliable flushing and cleaning of the borehole bottom can be achieved with a single flushing nozzle or with a relatively small number of flushing nozzles.

A particularly economical implementation of the method follows according to a further development of the invention in that a movement of the at least one flushing nozzle is caused by a blowback of the flushing jet. Great amounts of apparatus are not therefore needed to carry out the method.

BRIEF DESCRIPTION OF THE SEVERAL VIEWS OF THE DRAWINGS

The invention will be described in greater detail below with the aid of a preferred embodiment which is shown schematically in the attached drawings, in which.

DETAILED DESCRIPTION OF THE INVENTION

Figure 1:
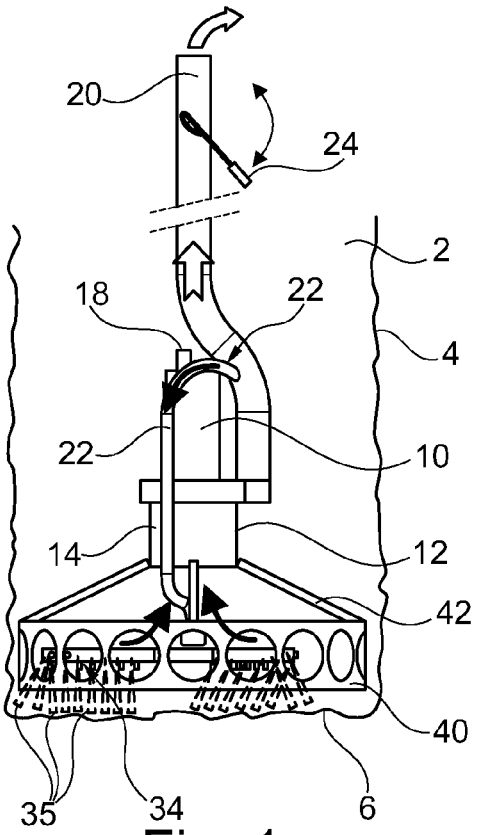
FIG. 1 shows a schematic cross-sectional view of a cleaning device according to the invention in a borehole.
Figure 2:
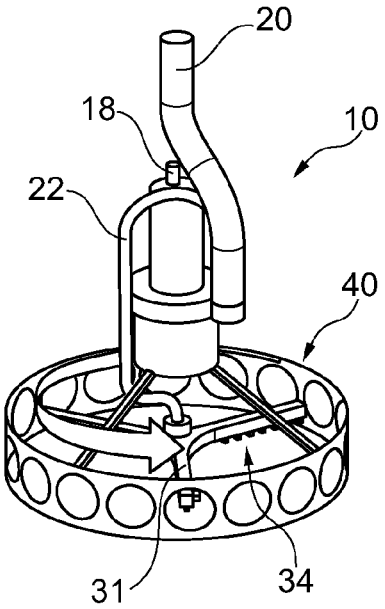
FIG. 2 shows a perspective view of the cleaning device of FIG. 1.
Figure 3:
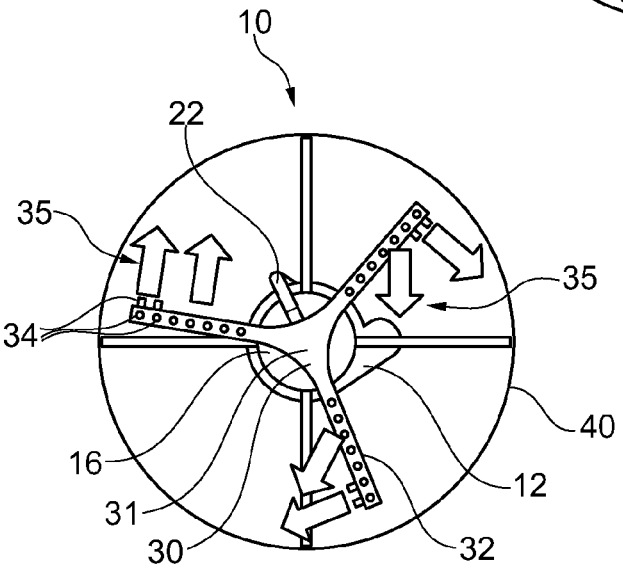
FIG. 3 shows a perspective view from below of the cleaning device according to the invention of FIGS. 1 and 2.
Figure 4:
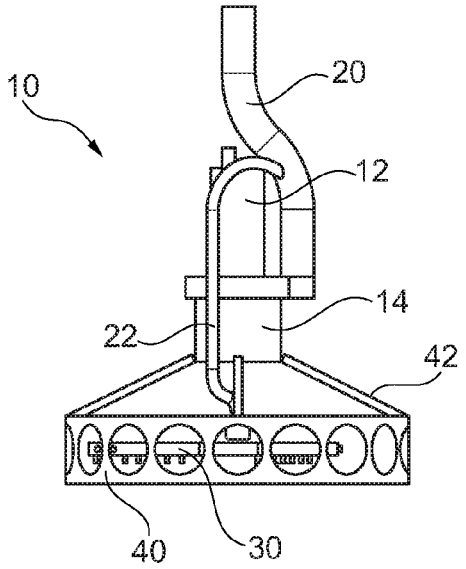
FIG. 4 shows a side view of the cleaning device of FIGS. 1 to 3.
Figure 5:
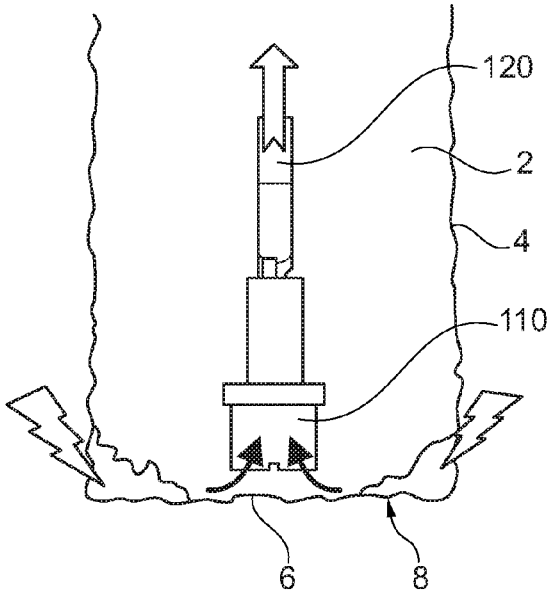
Fig. 5 PRIOR ART
FIG. 5 shows a conventional cleaning device according to the prior art in a borehole in a side view.
Figure 6:
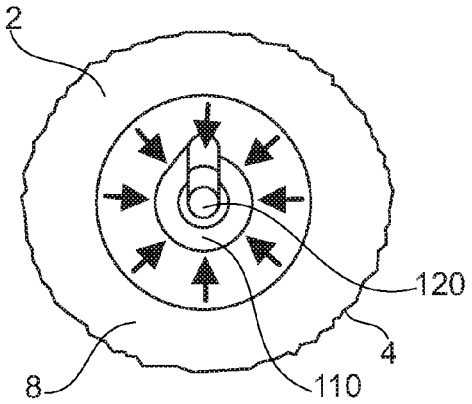
Fig. 6 PRIOR ART
FIG. 6 shows a perspective top view of the cleaning device of FIG. 5 from above.

FIGS. 5 and 6 show a cleaning device 110 according to the generic prior art. The cleaning device 110 is thereby essentially an immersion pump which is lowered into a borehole 2 which is filled with a liquid support suspension. When creating the borehole 2, ground material falls away in particular from the wall 4 and forms a layer of sedimented ground material 8 at the bottom 6 of the borehole 2. By lowering the cleaning device 110 into the region of the bottom 6 the sedimented ground material 8 is sucked away and, as shown schematically by arrows, conveyed away from the borehole 2 via a suction line 120.

With increasing distance from the cleaning device 110 the suction power reduces so that sedimented ground material 8, in particular in edge or corner regions of the bottom 6 of the borehole 2, can remain to a certain extent. This sedimented ground material 8 that is not sucked away impairs the contact area of a foundation element to be formed in the borehole 2 and thus the load bearing capacity thereof.

An improved cleaning of the bottom 6 of the borehole 2 with respect to sedimented ground material 8 is achieved by a cleaning device 10 according to the invention, as shown for example in FIGS. 1 to 4 for a cylindrical borehole 2 and as will be explained below.

The cleaning device 10 according to the invention has a central, drum-shaped housing 12, in which a pumping means 14 is arranged. By means of a suction opening 16 on the lower side of the housing 12, as according to the preceding prior art, suspension in the borehole 2 is sucked together with sedimented ground material from the bottom 6 of the borehole 2 and discharged upwards via an only partially shown suction line 20, in particular to the outside of the borehole 2. A suspension means 18 is provided at the top side of the housing 12, with which the cleaning device 10 hangs on a cable and can be lowered into the borehole 2 created by drilling. Via the suspension means 18, an energy supply, in particular electrical energy or hydraulic energy, can be additionally supplied via a supply line (not shown).

For improved cleaning of the bottom 6 of the borehole 2 a rotor 30 with three evenly distributed and radially orientated flushing arms 32 is formed below the suction opening 16, the flushing arms 32 each having a plurality of flushing nozzles 34. The rotor is mounted to be rotatable on the housing 12 via a connecting means that is not shown.

A portion of the liquid flow in the suction line 20 is branched off via a branch line 22 and fed downwards to a hub 31 of the rotor 30. The distribution of the flow can be adjusted via a slider 24 in the suction line 20. From the central hub 31, the branched-off liquid is fed through the hollow flushing arms 32 to the flushing nozzles 34. Through a corresponding adjustment of the slider 24 and pumping means 14, the branched-off liquid exits the flushing nozzles 34 under pressure and forms flushing jets 35. A considerable proportion of the flushing nozzles 34 are thereby arranged so that the flushing jets are oriented relative to the bottom 6 with the sedimented ground material 8 in order to flush the bottom 6 free from the sedimented ground material 8. The flushed-out and swirled-up ground material 8 is sucked away via the suction opening in the housing 12 and discharged from the borehole 2 via the suction line 20.

Two flushing nozzles 34 are respectively arranged on the rotor 30 at the outer free ends of the flushing arms 32 so that the flushing nozzles 34 are oriented in the circumferential direction. Through these flushing nozzles 34 oriented in the circumferential direction, flushing jets 35 pointing in the circumferential direction are produced, as shown schematically in FIG. 3. Through the blowback principle, the rotor 30 is thus set in rotation anti-clockwise, as indicated by the arrow in FIG. 2.

To protect the rotor 30, a cylindrical spacer ring 40 is attached to the housing 12 via holding struts 42 in order to thus protectively surround the rotor 30. The wall of the spacer ring 40 is formed by a sheet metal, in which a plurality of passage openings are incorporated. The outer diameter of the circular spacer ring 40 is somewhat smaller than the bore diameter of the cylindrical bore 2.

The invention claimed is:

1. Cleaning device for cleaning a bottom of a borehole in the ground, with a pumping part, through which sedimented ground material in a region of the bottom of the borehole being sucked away via a suction opening and discharged from the borehole via a suction line, wherein at least one flushing nozzle is provided, the at least one flushing nozzle being configured to produce a flushing jet including liquid, which exits the cleaning device and flushes sedimented ground material from the bottom of the borehole, wherein a spacer ring is provided which surrounds a rotor or at least one rolling body, the spacer ring being drum-shaped and upwardly and downwardly open wherein the at least one flushing nozzle is directly exposed to the bottom of the borehole, wherein the pumping part is configured to suck the sedimented ground material together with the liquid in the borehole, wherein a branch line is configured to remove a portion of the liquid to the at least one flushing nozzle to form the flushing jet.

2. Cleaning device according to claim 1, wherein at least one flushing arm is provided, on which the at least one flushing nozzle is arranged.

3. Cleaning device according to claim 2, wherein the at least one flushing arm is a plurality of flushing arms the plurality of flushing arms being provided which extend radially relative to a middle axis of the pumping part.

4. Cleaning device according to claim 2, wherein the at least one flushing arm is arranged on the rotor which is mounted to be rotatable about a middle axis of the pumping part and driven.

5. Cleaning device according to claim 4, wherein a rotation movement of the rotor or the at least one rolling body is adapted to be produced by the flushing jet.

6. Cleaning device according to claim 1, wherein the at least one flushing nozzle is arranged on the at least one rolling body which is mounted to be rotatable about a rotation axis, the rotation axis being the same as the middle axis of the pumping part and driven.

7. Cleaning device according to claim 1, wherein the pumping part is arranged in a housing which is adapted to be lowered to the bottom of the borehole.

8. Cleaning device according to claim 1, wherein the at least one flushing nozzle and/or at least one flushing arm is adapted to be adjusted.

9. Method for creating a foundation element, comprising:

incorporating a borehole in the ground, filling the borehole with a hardenable suspension which hardens to form the foundation element, wherein, before hardening of the foundation element, lowering a cleaning device to a bottom of the borehole, through which sucking away and removing sedimented ground material in a region of the bottom via a suction opening, wherein using the cleaning device with at least one flushing nozzle, with which producing a flushing jet including liquid, through which flushing sedimented ground material from the bottom of the borehole, wherein the cleaning device includes a spacer ring which surrounds a rotor or at least one rolling body, the spacer ring being drum-shaped and upwardly and downwardly open wherein the at least one flushing nozzle is directly exposed to the bottom of the borehole, wherein a pumping part sucking the sedimented ground material together with the liquid in the borehole, wherein a branch line removing a portion of the liquid to the at least one flushing nozzle to form the flushing jet.

10. Method according to claim 9, wherein moving the at least one flushing nozzle over the bottom of the borehole, and driving the at least one flushing nozzle in rotation.

11. Method according to claim 10, wherein bringing a movement of the at least one flushing nozzle about via a blowback of the flushing jet.

* * * * *